United States Patent [19]

Jingin et al.

[11] Patent Number: 4,722,652

[45] Date of Patent: Feb. 2, 1988

[54] HYDRAULIC VANE TYPE PUMP

[75] Inventors: Liu Jingin; Li Zhuangyun; Liu Xiangsheng; Zeng Shuang; Wu Hanyi; Wang Yan, all of Wuhan, China

[73] Assignee: Huazhong Institute of Technology, China

[21] Appl. No.: 846,810

[22] Filed: Apr. 1, 1986

[30] Foreign Application Priority Data

Apr. 1, 1985 [CN] China ..... 85200887

[51] Int. Cl.[4] ..... F04B 23/10

[52] U.S. Cl. ..... 417/204; 418/268

[58] Field of Search ..... 418/267, 268; 417/199 R, 204

[56] References Cited

U.S. PATENT DOCUMENTS

| | | | |
|---|---|---|---|
| 3,102,494 | 9/1963 | Adams | 418/268 |
| 3,195,372 | 7/1965 | Clark et al. | 417/204 X |
| 3,402,891 | 9/1968 | Clark et al. | 417/204 X |
| 3,828,569 | 8/1974 | Weisgerber | 418/268 X |
| 4,505,653 | 3/1985 | Roberts | 418/268 X |
| 4,516,920 | 5/1985 | Shibuya | 418/268 X |

*Primary Examiner*—Carlton R. Croyle

*Assistant Examiner*—Theodore Olds

*Attorney, Agent, or Firm*—Hill, Van Santen, Steadman & Simpson

[57] ABSTRACT

A vane type pump suitable for a hydraulic system comprises passages communicating with the underside of the vanes in the inlet quadrant with the surrounding of the drive shaft and passages communicating the underside of the vanes in the discharge quadrant with the discharge chamber, thereby the underside of the vanes can act as a set of additional little pumps while being ineffective at zero pressure. The undervane pressure in the inlet quadrant can be tested and adjusted at any time during the operation by a manometer and an auxiliary valve. The vane type pump in accordance with the present invention is adapted to various viscosities of fluid such as 1–38 cst, 50° C., and it is possible to work at negative pressure without keeping the reservoir a certain relative height and without replacing the inner component. The pump works at a high volumetric efficiency and total efficiency all the time. This vane type pump is, particularly, suitable for static pressure bearing and guide track, hydraulic servo, proportional and HWBF hydraulic transmission systems.

7 Claims, 2 Drawing Figures

HYDRAULIC VANE TYPE PUMP

BACKGROUND OF THE INVENTION

1. Field of the Invention

This invention relates to hydraulic vane type pumps and more particularly to such pumps having undervane pressure to assist vane extension.

2. Description of the Prior Art

The known vane type pumps, as normal, have a volumetric efficiency up to 80%–90% when middle viscosity fluid (17–38 cst 50° C.) is used. But the volumetric efficiencies are very low, when a low viscosity fluid (below 6 cst 50° C.) is applied e.g. with high water base fluids (HWBF) (95% water, 5% additives, viscosity 1.1 cst) the volumetric efficiencies may go down as low as 30%–50% (working pressure 63 kgf/cm$^2$ and displacement 10–32 ml/r).

According to the following reference:

(1) Retrofitted vane type pump handles high water base fluids "Design News" Vol. 37. No. 12.

June 22, 1981

(2) Vane and Gear pumps for high water base fluids <<Sperry Vickers HWBF meeting transcript –5th>>

Nov. 29, 1979

The highest volumetric efficiency of the U.S. sperry Vuckers F6 series HWBF vane type pump can reach to 82%–85% (working pressure 70 kgf/cm$^2$) due to its large displacement (38–120 ml/r). However, the application of the F6 series are restricted to use with only low viscosity fluids. They are not adapted to middle viscosity fluid. If the middle viscosity fluid is applied, the pump's vanes would disconnect from the cam ring and the volumetric efficiency drops down too low to continue working. To fit the condition of a non-negative inlet pressure a frame is needed to support the reservoir to a height such that the bottom of the reservoir is 1.5–2.0 m above the pump inlet, thus increasing the equipment's cost and requiring more space. In the case that the inlet pressure is negative, to adapt the using of middle viscosity fluid or the eliminating of the support of the reservoir, the inner component of the pump must be replaced. The inner component bears 70%–80% total cost of the pump, its complicated construction requires higher accuracy and is difficult to manufacture.

The vane type pump published as EP-101-758-A (filed on Sept. 1, 1982 by U.S. Sperry Vickers Co. and issued on Mar. 7, 1984) also has the above-mentioned disadvantages.

In addition, the known vane type pumps further have a disadvantage that the under-vane pressure can not be adjusted during the operation, thus resulting the wear of the top of the vanes and particularly, the heave wear of the inner surface of the cam ring in the inlet quadrant, reducing the overall life of the pumps.

SUMMARY OF THE INVENTION

It is therefore one of the objects of the present invention to provide a vane type pump which is adapted to be used with various viscosities of fluids without replacing the inner component and which can achieve a high volumetric efficiency as well as a high total efficiency of the pump.

A further object of the present invention is to provide such a vane type pump in which the undervane pressure in inlet quadrant can easily be tested and adjusted at any time during the operation, hence minimizing the interaction between the top of the vanes and the inner surface of the cam ring while maintaining their connection so as to increase the pump's efficiencies and the overall life.

Yet, another object of the present invention is to provide a vane type pump that whether a low or a middle viscosity fluid is being used, the inlet pressure can be negative, without any need to position the reservoir higher than the pump.

These objects are accomplished in accordance with the principles of this invention by providing a vane type pump which comprises passages communicating the underside of the vanes arranged inlet quadrant and discharge quadrant with the surroundings of the drive shaft and the discharge chamber, respectively while the discharge chamber is connected to surroundings of the drive shaft via auxiliary valve, in these ways the underside of the vanes can act as an additional pump during the operation while being ineffective at zero pressure, thus increasing the volumetric efficiency and total efficiency of the vane type pump. The undervane pressure can be controlled by the auxiliary valve so as to minimize the interaction between the top of vanes and the inner surface of the cam ring while maintaining their contact or connection. The undervane pressure is shown by the manometer.

These and other features objects and advantages of the present invention will become apparent from the detailed description and claims to follow, taken in conjunction with accompanying drawings.

DETAILED DESCRIPTION OF THE PREFERRED EMBODIMENT

Figure 1:
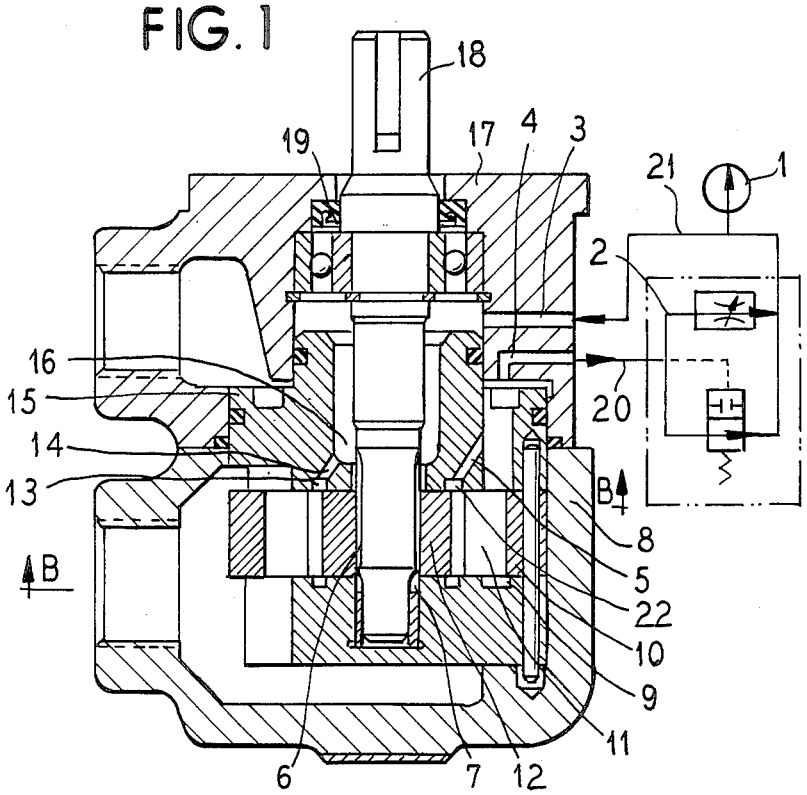
FIG. 1. is a longitudinal section view of a preferred vane type pump according to this invention, taken along the line A—A in FIG. 2.
Figure 2:
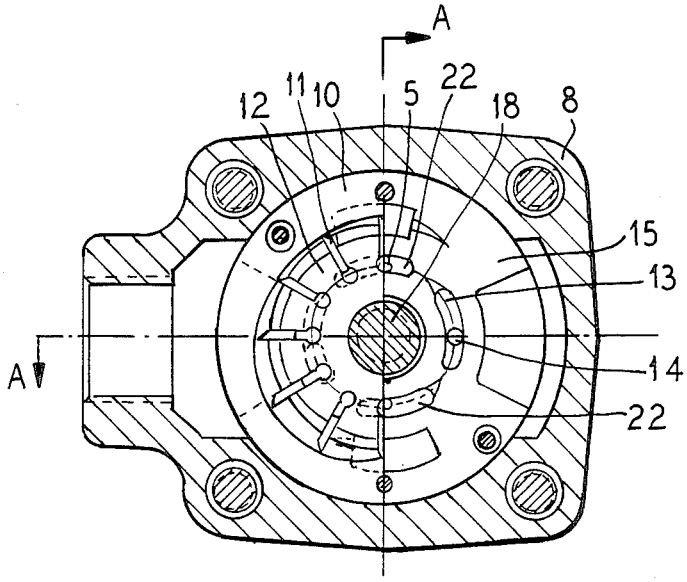
FIG. 2 is a transverse section view taken along the line B—B in FIG. 1.

Referring to the drawings, the vane type pump in accordance with the present invention generally comprise manometer 1, auxiliary valve 2, end cap 8, side plate 9, cam ring 10, vanes 11, rotor 12, pressure side plate 15, housing 17, drive shaft 18, shaft seal means 19, suction slot 14, pressing slot 5, high pressure channel 4 and low pressure channel 3.

There are three gaps 16,6,7 in the pump. The first gap 16 is defined between the drive shaft 18 and the pressure side plate 15, the second gap 6 is defined between the spline of the drive shaft 18 and the spline hole of the rotor 12, the third gap 7 is defined between the drive shaft 18 and the side plate 9. These three gaps 16, 6, 7 communicate with each other but none communicate with inlet chamber.

At least one of said gaps is communicated with the kidney-shaped passages 13 which are arranged at the inlet quadrant at the side of said pressure side plate 15 and said side plate 9 through at least two suction slots 14 in said pressure slide plate 15 or said plate 9, said kidney-shaped passage 13 further connected to the underside of the vanes in the inlet quadrant. Kidney-shaped passages 22 are connected to the underside of the vanes in the discharge quadrant and communicate with the discharge chamber through at least two pressing slots 5, said housing 17 is provided with at least one high pressure channel 4 and at least one low pressure channel 3 which communicate with each other through an auxiliary valve 2. The inlet of the auxiliary valve 2 connects to the discharge chamber through said high pressure channel 4 and the outlet of the auxiliary valve 2 is connected to said gaps 16,6,7 through the low pressure channel 3, said manometer 1 being connected to said low pressure channel 3.

Said auxiliary valve 2 may be a flow valve in parallel with a two-position, two-way valve (the later one is open only at low pressure), or only a flow valve. The flow valve may be an adjustable compensating flow-control valve, a proportional flow valve, or a servo flow valve. The two-position, two-way valve may be controled by hydraulic, mechanical, electro-magnetic means or electro-hydraulic. Said shaft seal means 19 is an abrasion resisting and pressure resisting seal.

Said auxiliary valve 2 and manometer 1 may either be mounted to the control board (not shown in drawings) and connected through a inlet pipe 20 and a outlet pipe 21 to said housing 17 or be mounted directly to housing 17.

During the operation, the underside of the vanes act as a set of additional little pumps by sucking the fluid which leaks towards the axis of said drive shaft 18 in the inlet quadrant and pressing it into the discharge chamber while it is in the discharge quadrant. In this way, the fluid leakage loss is utilized while the underside of the vanes stop their pumping effect at zero pressure, thus, the volumetric efficiency is increased greatly.

In order to keep the top of the vanes in said inlet quadrant in contact with the inner surface of said cam ring 10 while maintaining their interaction at the smallest magnitude so as to increase the volumetric efficiency, total efficiency and the overall life of the pump, a small amount of fluid is brought from the discharge chamber into the underside vanes in the inlet quadrant through said high pressure channel 4, inlet pipe 20, auxiliary valve 2, outlet pipe 21, low pressure channel 3, first gap 16 and said suction slot 14 and the kidney-shaped passages 13 to maintain a certain undervane pressure which can be tested by the manometer 1 and adjusted by the auxiliary valve 2. Generally the undervane pressure is about 3 kgf/cm$^2$ By changing the size of said pressure slots 5, the phase angle of said kidney-shaped passage 22,13, the top of said vanes 11 can be kept in contact with the inner surface of said cam ring 10 and in the discharge quadrant and circular arc quadrant, their interaction can be kept in a minimum value, so as to further increase said efficiencies and overall life of the pump.

The vane type pump according to the present invention is adapted to various viscosities of fluids (such as 1–38 cst 50° C.) and can achieve a high volumetric efficiency and a high total efficiency all the time. For example when HWBF are used, experiments show that the volumetric efficiency can go up as high as 85%–92% (working pressure 70 kgf/cm$^2$, displacement 10–32 ml/r, the mechanical efficiency has no distinguishable change compared with the known vane type pump under the same displacement). The inlet pressure can be negative, thus, the elevation of the reservoir to a certain height is eliminated, and it is easy to make technical reforms to former equipment without increasing the equipment cost. Under the same load, the power loss in the transmission line is reduced by 75%–85%, the working pressure is reduced by 5–10 kfg/cm$^2$, the power loss in spill valve is reduced by 5%–10% when the vane type pump in accordance with the present invention is used. The reservoir can be minimized and the cooling system can be eliminated due to a small amount of heat produced. The fluid applied to the pump need not change in different seasons, therefore the cost of the fluid can be reduced by 30%–40%.

During the operation, the undervane pressure in the inlet quadrant can be easily tested and adjusted at any time by said manometer 1, and said auxiluary valve 2. This arrangement has a simple construction, it is not necessary to enhance the manufacturing precision, so it is easy to be manufactured at a low cost. Said auxiliary valve 2 and manometer 1 are mounted on the control board of the hydraulic system, so they are easy to be handled. Instead of equipping an auxiliary valve for each pump, only one auxiliary valve is needed for each system.

The vane type pump according to the pressent invention is, particularly, suitable for static pressure bearing, static pressure guide track, hydraulic servo, proporational and HWBF hydraulic transmission systems in which low viscosity fluid is used, and it is also suitable for conventional hydraulic transmission systems.

We claim:

1. A vane type pump having a discharge quadrant formed by a housing with a discharge chamber and a discharge opening, an inlet quadrant formed by an end cap with an inlet chamber and an inlet opening, said housing and end cap held together in abutting relationship, an opening through said housing for passage of a drive shaft which is journalled within said pump housing in a side plate abutting against said end cap, a rotor carrying pumping vanes rotatably carried on said drive shaft and positioned between said side plate and a pressure side plate, said pressure side plate abutting against said housing and surrounding said drive shaft, but being spaced therefrom by a first gap, said rotor being operably connected to said drive shaft through a spline connection and a second gap being provided between said drive shaft and rotor, said side plate surrounding an end of said drive shaft and having a portion spaced from said drive shaft to define a third gap between said drive shaft and said side plate, said first, second and third gaps being in fluid communication, said pressure side plate having a kidney-shaped passage therein which communicates with the underside of the vanes in the discharge quadrant, said side plate having a kidney-shaped passage therein which communicates with the underside of the vanes in the inlet quadrant, comprising:

at least two pressing slots being provided in at least one of said side plate and pressure side plate, said kidney-shaped passage in said discharge quadrant communicating with said discharge chambers through said pressing slots;

at least two suction slots being provided in at least one of said side plate and pressure side plate, said kidney-shaped passages in the inlet quadrant communicating with one of said gaps through said suction slots, said gaps not being in communication with said inlet chamber;

at least one high pressure channel and at least one low pressure channel being provided in said housing of said pump, said low pressure channel communicating with said gaps and said high pressure communicating with said discharge chamber;

an auxiliary valve with its inlet connected to said high pressure channel and its outlet connected to said low pressure channel; and a manometer being connected to said low pressure channel.

2. A vane type pump as defined in claim 1, wherein said auxiliary valve is a flow valve in parallel with a two-position, two-way valve, the two position, two-way valve being open only at low pressure.

3. A vane type pump as defined in claim 1, wherein said auxiliary valve is a flow valve.

4. A vane type pump as defined in claim 3, wherein said flow valve is a adjustable compensated flow-control valve.

5. A vane type pump as defined in claim 3, wherein said flow valve is a proportional flow valve.

6. A vane type pump as defined in claim 3, wherein said flow valve is a servo flow valve.

7. A vane type pump as defined in claim 1, wherein said shaft seal means is an abrasion resisting and pressure resisting seal.

* * * * *